US005437907A

United States Patent [19]

Peil et al.

[11] Patent Number: 5,437,907

[45] Date of Patent: Aug. 1, 1995

[54] REMOVABLE REFLECTIVE TAPE OR SHEETING

[75] Inventors: Fred G. Peil, St. Louis; Herbert J. Kramer, Ballwin, both of Mo.

[73] Assignee: Flex-O-Lite, Inc., Clayton, Mo.

[21] Appl. No.: 982,232

[22] Filed: Nov. 25, 1992

Related U.S. Application Data

[63] Continuation of Ser. No. 459,563, Jan. 2, 1990, abandoned.

[51] Int. Cl.[6] ..... B32B 5/16

[52] U.S. Cl. ..... 428/143; 404/10; 404/14; 428/147; 428/325; 428/340; 428/343; 428/354; 428/523; 523/172

[58] Field of Search ..... 428/325, 327, 340, 343, 428/354, 143, 147, 523; 404/10, 14; 523/172; 350/105

[56] References Cited

U.S. PATENT DOCUMENTS

| | | | |
|---|---|---|---|
| 2,330,843 | 10/1943 | Rodli et al. | 94/1.5 |
| 4,339,485 | 7/1982 | Shibano et al. | 428/40 |
| 4,425,176 | 1/1984 | Shibano et al. | 156/244.11 |
| 4,443,510 | 4/1984 | Watt | 428/280 |
| 4,648,932 | 5/1987 | Bailey | 428/325 |
| 4,849,265 | 7/1989 | Ueda et al. | 428/40 |
| 4,955,690 | 9/1990 | Bacon, Jr. | 350/105 |

*Primary Examiner*—D. S. Nakarani
*Assistant Examiner*—H. Thi Lê
*Attorney, Agent, or Firm*—Edward H. Renner

[57] ABSTRACT

Roadway traffic control marking tape and reflective sheeting are known in the art for providing temporary delineation and demarcation of traffic lanes in order to guide the flow of traffic through detours, construction areas and the like. Traffic channelizers and barricades are also well known in the art as barriers to discourage crossing the lanes onto the other side thereof. When work on highway lanes is completed, and traffic is redirected to newly opened lanes, the tape is generally removed. When it breaks during removal the job is particularly demanding. Damage to traffic channelizing devices which are hit by fast moving vehicles leads to their frequent replacement. Hence it has become desirable to recycle them. The recycling process requires that the reflective sheet first be removed. But the recycling process too has been hampered by the difficulty of sheet breaking during its removal. Accordingly there is a need for a traffic control marking tape or sheet, as disclosed, which is so improved that it will better resist breaking or delaminating on removal. Herein a tape or sheet is provided which can readily be pulled off of a road surface or a traffic channelizing device without breaking or delaminating.

6 Claims, 2 Drawing Sheets

REMOVABLE REFLECTIVE TAPE OR SHEETING

This is a continuation of application(s) Ser. No. 07/459,563 filed on Jan. 2, 1990 now abandoned.

BACKGROUND OF THE INVENTION

This invention relates to reflective marking tapes and sheeting used on roadways to control the flow of traffic, and on traffic control devices or channelizers which warn vehicle operators of hazards on the nontraffic side of such traffic channelizers. More particularly the invention relates to removable traffic control marking tapes and sheeting of high visibility and reflectivity.

Applicants are aware of the following U.S. Pat. Nos., the disclosures of which are incorporated by reference herein:

2,330,843
4,083,033
4,339,485
4,425,177
4,443,510
4,470,053
4,849,265

Roadway traffic control marking tapes are known in the art, an example being U.S. Pat. No. 4,443,510. Such marking tapes are especially useful in providing temporary delineation and demarcation of traffic lanes in order to guide the flow of traffic through detours, construction areas and the like.

Traffic delineators, such as barracades and channelizers are also well known in the art, as can be seen in U.S. Pat. No. 4,083,033 and U.S. Pat. No. 4,470,053. They are traffic control devices, e.g. in the form of barrels and cones, standing as barriers to discourage crossing the lanes onto the other side thereof. Metallic drums have been employed as traffic channelizers. However to avoid problems which developed during their use, such metal drums have, for the most part, been replaced by plastic channelizers. Present day traffic channelizers are one or two piece devices having bottoms for storing stabilizing means, such as sandbags. Two piece channelizing devices can be assembled in a stabilized condition as disclosed in U.S. Pat. No. 4,083,033.

Traffic control channelizers sometimes are provided with warning lights, which are usually mounted on the tops of the units. In addition reflective marking tape or sheeting has been used on traffic channelizers. The reflective marking tape or sheeting affixed to such traffic channelizing devices renders them more visible, particularly at night, so that the traffic will not proceed into the area beyond the traffic channelizing devices.

It will be appreciated that in use highway marking tape and sheeting must be able to resist a wide range of stresses without tearing. Severe stresses, whether on roadways or on traffic channelizers, have led to the provision of thicker tapes. But in the case of roadways their thickness causes them to protrude, resulting in movement or squirming of the tape from traffic impact. Moreover, these thicker tapes are subjected to even greater stresses, as well as to increased abrasion and fracture. When work on highway lanes is completed, for example, and traffic is redirected to newly opened lanes, it is preferred that the tape be removed. When the tape tears or breaks during removal as a result of abrasion or fracture, the job is particularly demanding and time consuming.

Reflective tape on traffic channelizers is also subject to being torn, particularly when the channelizing device is hit by a vehicle. When the traffic tape is torn on impact it must be replaced if driving conditions are to be safe at night. Tape which delaminates on being removed from the channelizers also results in increased time in cleanly removing the tape or sheeting. Conventional channelizer sheeting is essentially non-removable by practical means.

Damage to traffic channelizing devices which are hit by vehicles leads to frequent replacement of the channelizers themselves. In view of the number destroyed, it becomes desirable to recycle them. The recycling process requires that the reflective tape or sheet first be removed. Consequently the recycling process too has been hampered by the difficulty of tape tearing or delaminating during its removal. Accordingly there is a need for a traffic control marking tape or sheeting which is so improved that it will better resist delamination, tearing and separation on removal. Herein a tape or sheeting is provided which can readily be pulled off of a road surface or a traffic channelizing device without tearing, delaminating or breaking.

SUMMARY OF THE INVENTION

By the practice of this invention a tear and breakage resistant traffic control marking sheeting or tape is provided having adhesion to surfaces of traffic channelizing devices, and of roadways. The traffic marking tape or sheet is in the form of a multilayer composite structure including an upper layer in the form of a film having a reflective outer surface or face. A supporting layer for the upper reflective surface, which may be a composite film, is included in the form of a plastic film having properties such that its breakage, fracture and tear resistance overcomes its adhesion to surfaces of channelizing devices and roadways on being pulled off of those surfaces. The supporting layer is bonded to the reflective layer by an intermediate layer of adhesive, rendering the entire traffic control tape resistant to breakage. The underside of the supporting layer carries a layer of an adhesive for bonding the traffic control marking tape or sheet to the highway or channelizer surfaces.

The invention may be further understood by reference to the following Description of the Drawings and Description of the Preferred Embodiments.

DETAILED DESCRIPTION OF THE INVENTION

This invention can, perhaps, be better understood from a description thereof in conjunction with the accompanying drawings.

Figure 1:
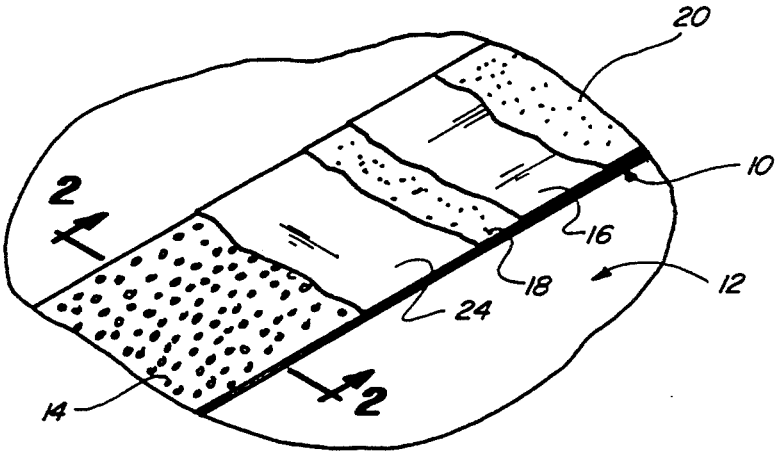
FIG. 1 is a perspective view, partially broken, of a roadway tape according to the invention.

In the drawing, FIG. 1 is a view of a portion of the traffic control marking tape or sheeting 10 adhered to a roadway 12. It will be appreciated that the term tape is generally used for material applied to roadways and sheeting is used for materials used for other purposes, but the two terms are used interchangeable here.

Referring further to the drawings, it will be noted that the traffic control marking tape or sheet 10 is provided as a multilayer composite. The top layer 14, is in the form of a reflective film or sheeting. This reflective layer 14 can can be any of the well known films such as the polyimides, polyesters, polycarbonates or polymethacrylates containing reflective components. The reflective top layer 14 can also be in the form of a clear plastic film which is then coated with a pigmented binder, such as epoxy, phenolic, polyester and vinyl resins having incorporated therein fluorescent, phosphorescent, iridescent, and metallic colorants, or monoazo, dianisidine and pyrazolone pigments, or other conventional pigments as well as high index glass beads and the like. If so coated, layer 14 can be a sheet of cloth, paper, foil or plastic in the form of a flexible film readily conforming to the surface 12 to which the traffic tape 10 is applied. Desirably the clear film being coated will be one of the commonly employed films such as those described hereinbefore.

Figure 5:
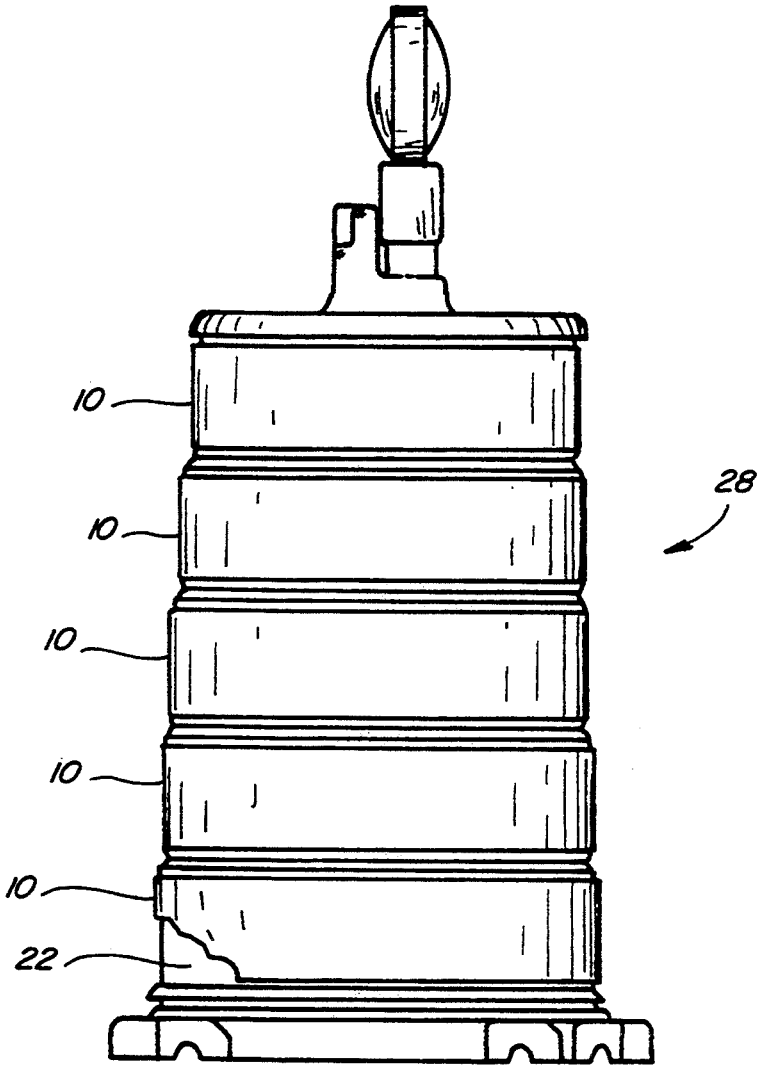
FIG. 5 is a view of applicants' reflective sheet mounted on a traffic channelizer.
Figure 6:
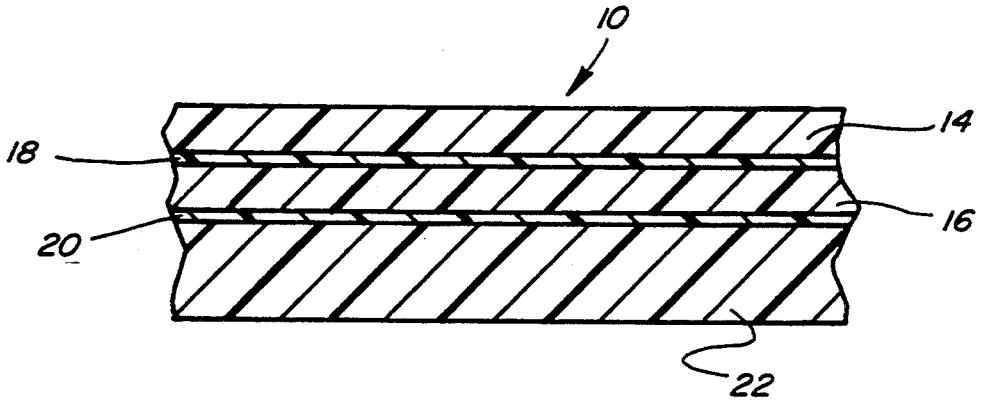
FIG. 6 is a cross-sectional view of the sheeting shown in FIG. 5.

As indicated, when traffic lanes are changed, or if traffic channelizing devices are to be retaped or recycled the traffic control tape or sheeting 10 must be removed. An important aspect of this invention is that of overcoming the adhesion to surface 12 so that the traffic tape 10 does not have to be removed in bits and pieces. To this end supporting layer 16 is employed. Supporting layer 16 is a plastic film having properties such that it substantially reduces breakage or fracture on being pulled off of road 12 or channelizing device surfaces 22, as shown in FIGS. 5 and 6. The film properties of this supporting layer typically include a film thickness of about 0.5 to 5 mils. The films may have a tensile strength of 3,000 psi or more, a tearing strength of up to about 600 g/mil or more, and an elongation of up to about 200 per cent or more without breakage. Such plastics are medium and high density polyethylenes, and polypropylenes, ethylenechlorotrifluoroethylene copolymers, ethylenetetrafluoro-ethylene copolymers, plasticized polyvinyl chloride, and the vinyl nitriles. This list is by no means exhaustive, and between about 0.5 to 5 mil plastic films can be fabricated with higher tensile strengths, say up to 10,000 psi, tearing strengths of up to 1400 g/mil and elongation values up to 1000 per cent using available plastic materials. The exact value is not critical. The desirable feature is to produce a composite using a film which provides sufficient fracture and breakage resistance to permit the composite to be cleanly removed after use.

It has been emphasized that a wide variety of polymeric film materials and adhesives are known in the art. Given the required properties for the tape of this invention other materials as well as modifications will occur to those skilled in the art. Such ramifications are deemed to be within the scope of this invention.

Figure 4:
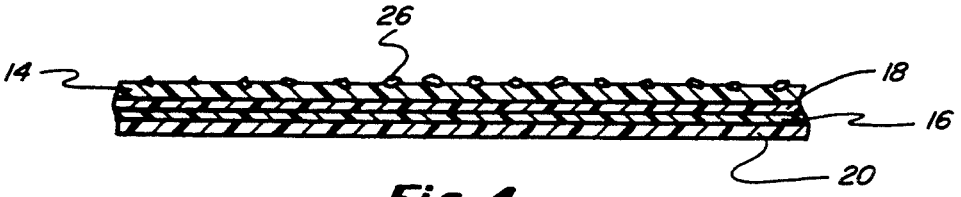
FIG. 4 is a cross-sectional view taken along the plane of line 4—4 in FIG. 3.
Figure 3:
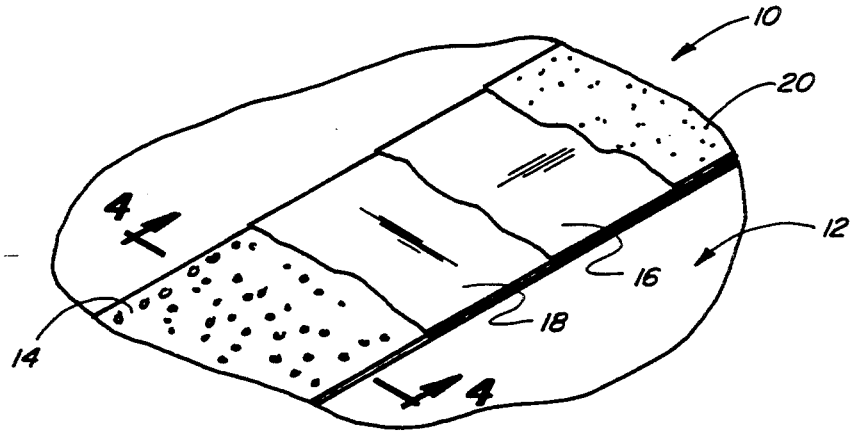
FIG. 3 is a view, similar to FIG. 1, of a further embodiment of applicants' marking tape.

Referring again to FIGS. 3 and 4, it will be seen that the upper reflecting surface 14 will be bonded to the tear-resistant supporting layer 16 by an intermediate layer of adhesive 18 so that the entire marking tape 10 is rendered resistant to breakage. In addition, the underside of supporting layer 16 carries a layer of an adhesive 20 for bonding the traffic control tape 10 to the road 12 or channelizer surface 22, as shown in FIGS. 5 and 6. With the understanding that the particular adhesive will depend upon its mode of application, adhesives are well known in the art. Thus, if pressure sensitive materials are used, exhibiting tack, such thermoplastic elastomeric materials as polybutadiene or polyisoprene will be used. If hot melt adhesives are employed, such thermoplastic adhesives as polyvinylacetate will be used, as well as thermosetting resins such as the epoxy resins, phenolic resins, polyacrylate resins and the urethanes.

Once fabricated, the tape or sheet 10 can be rolled up for storage and shipping as known in the art. The tape 10 can then be applied to the roadway 12 or channelizer surface 22 by any means known in the art. The tape of this invention conforms to the substrate, and remains in place. Upon removal a noticeable savings in time results. It can be readily removed without fragmentation and tearing even though it may not include a reinforcing of the type known in the prior art. Testing indicates that one application may last up to four months under reasonably severe conditions, such as at a detour in a busy location with heavy traffic.

The preferred method of fabrication is by sequential application of lamina and coating layers, e.g. by roll coating, as is known in the art and as described in U.S. Pat. No. 4,443,510. Reflective spheres, crushed glass and other surface treatments may be applied, as known.

Figure 2:
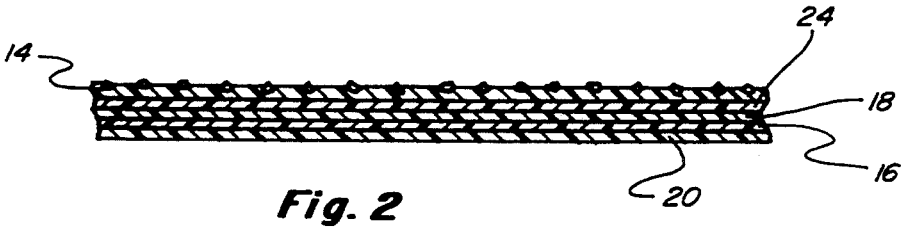
FIG. 2 is a cross-sectional view taken along the plane of line 2—2 in FIG. 1.

Referring to FIGS. 1 and 2, a thin film of aluminum may be included in a roadway tape 10, as known, to increase the deadness or conformability of the tape 10 to an uneven roadway surface 12. A particularly effective composite for roadway use has been prepared using a 0.0035 mil aluminum layer 24, an adhesive layer 18 of Midwest 21.3 - 1 (TM) adhesive, a supporting layer 16 of 1.5 mil high density polyethylene film and an adhesive layer 20 of Elecktronek 5P2517 (TM) adhesive. The top coating 14 has been formed of pigmented vinyl paint, for a roadway tape 10. Reflective elements 26 may be included in top coating or layer 14. These elements 26 may include reflective glass beads such as 30–40 mesh, 1.9 index reflective spheres or may be a mixture of such spheres and crushed glass, such as 70–80 mesh crushed 1.5 index glass. A mixture of between about 75% spheres and 25% crushed glass has been found particularly effective to provide a highly reflective and skid resistant surface. Other mixtures and materials could also be used. Where the sheeting is to be used on channelizers 28 or barracades and the like, as shown in FIGS. 5 and 6, it will be appreciated that the top layer or film 14 may be a conventional reflective sheeting, such as FASON 6200 Hi-Tack Channelizer Tape (TM).

There are various changes and modifications that may be made to the invention described herein, as will be appreciated by those skilled in the art, without departing from the spirit of the disclosed invention. It is intended that applicants not be limited to the specific embodiments, which are disclosed herein for purposes of illustration, but be limited only by the scope of the claims appended hereto and their equivalents.

What is claimed is:

1. A marking tape having adhesion to supporting surfaces comprising a multi-layer composite structure including an upper layer in the form of a film having a reflective face, a supporting layer in the form of a plastic film having properties such that its breaking resistance is effective to overcome adhesion to those surfaces on being pulled off of the surfaces, the supporting layer including a high-density polyethylene film having a film thickness of between about 0.5 to 5 mils, a tensile strength of about 3,000 psi or more, a tearing strength of about 600 g/mil or more, and an elongation of about 200% or more, the upper layer being bonded to the supporting layer by an intermediate layer of adhesive so that the entire marking tape is rendered highly resistant to fracture and breakage and the tape may be substantially cleanly removed from those supporting surfaces, the underside of the supporting layer carrying a layer of adhesive for bonding the tape to said surfaces.

2. The tape of claim 1 wherein the tape is a roadway marking tape, the upper layer of which is a plastic film having a reflective coating on its face including a binder having a pigment incorporated therein and having glass beads incorporated therein.

3. The tape of claim 2 wherein the tape includes an aluminum lamina placed between the upper layer and the supporting layer.

4. The tape of claim 1 wherein the tape is a reflective tape for traffic channelizers, the upper layer of which is a plastic film having a reflective coating on its face including a binder having a pigment incorporated therein.

5. The tape of claim 4 wherein the upper layer is a reflective sheeting.

6. The tape of claim 4 wherein the binder has crushed glass incorporated therein.

* * * * *